US007317161B2

(12) United States Patent
Fukuda

(10) Patent No.: US 7,317,161 B2
(45) Date of Patent: Jan. 8, 2008

(54) SHIELDED CABLE, AND BIOELECTRICAL IMPEDANCE VALUE OR BIOLOGICAL COMPOSITION DATA ACQUIRING APPARATUS USING THE SAME

(75) Inventor: Yoshinori Fukuda, Tokyo (JP)

(73) Assignee: Tanita Corporation, Tokyo (JP)

( * ) Notice: Subject to any disclaimer, the term of this patent is extended or adjusted under 35 U.S.C. 154(b) by 0 days.

(21) Appl. No.: 10/978,983

(22) Filed: Nov. 2, 2004

(65) Prior Publication Data

US 2005/0098343 A1 May 12, 2005

(30) Foreign Application Priority Data

Nov. 7, 2003 (JP) ..... 2003-378796

(51) Int. Cl.
*H01B 7/34* (2006.01)

(52) U.S. Cl. ..... 174/36; 174/74 R

(58) Field of Classification Search ..... 174/28, 174/74 R, 75 C, 102 R, 103, 104
See application file for complete search history.

(56) References Cited

U.S. PATENT DOCUMENTS

| | | | | |
|---|---|---|---|---|
| 3,626,287 | A * | 12/1971 | Di Niro | 324/688 |
| 3,975,700 | A * | 8/1976 | Halstead | 333/237 |
| 4,335,412 | A * | 6/1982 | Aschwanden | 361/50 |
| 4,376,920 | A * | 3/1983 | Smith | 333/12 |
| 4,669,479 | A * | 6/1987 | Dunseath, Jr. | 600/391 |
| 4,890,630 | A * | 1/1990 | Kroll et al. | 600/508 |
| 4,987,394 | A * | 1/1991 | Harman et al. | 333/237 |
| 5,095,891 | A * | 3/1992 | Reitter | 601/4 |
| 5,150,442 | A * | 9/1992 | Desmons | 385/101 |
| 5,159,276 | A * | 10/1992 | Reddy, III | 324/678 |
| 5,392,784 | A * | 2/1995 | Gudaitis | 600/508 |
| 5,417,221 | A | 5/1995 | Sickler | |
| 5,755,226 | A * | 5/1998 | Carim et al. | 600/323 |
| 5,818,243 | A * | 10/1998 | Wakamatsu | 324/649 |
| 6,724,200 | B2 | 4/2004 | Fukuda | |
| 7,138,813 | B2 * | 11/2006 | Cowan et al. | 324/760 |

FOREIGN PATENT DOCUMENTS

| | | | |
|---|---|---|---|
| EP | 1 078 596 | | 2/2001 |
| JP | 3024770 | A * | 6/1996 |
| JP | 2001-61804 | | 3/2001 |
| JP | 2001-061804 | A * | 3/2001 |

OTHER PUBLICATIONS

Settle, et al., "Nutritional Assessment: Whole Body Impedance and Body Fluid Compartments", Nutrition and Cancer, 1980, vol. 2, No. 1, pp. 72-80.

* cited by examiner

*Primary Examiner*—William H. Mayo, III
(74) *Attorney, Agent, or Firm*—McDermott Will & Emery LLP

(57) ABSTRACT

There are provided a shielded cable having a core wire for carrying an electrical signal, and a shield around the circumference of the core wire and connected to the core wire via a drive circuit, wherein the drive circuit has a band limiting circuit which decreases an output voltage in a predetermined frequency band; and an apparatus which acquires a bioelectrical impedance value or biological composition data by using the shielded cable.

6 Claims, 4 Drawing Sheets

SHIELDED CABLE, AND BIOELECTRICAL IMPEDANCE VALUE OR BIOLOGICAL COMPOSITION DATA ACQUIRING APPARATUS USING THE SAME

BACKGROUND OF THE INVENTION (i) Field of the Invention

This invention relates to a shielded cable used to carry an electrical signal and to an apparatus which acquires a bioelectrical impedance value or biological composition data by using the shielded cable.

(ii) Description of the Related Art

An apparatus which acquires a bioelectrical impedance value by supplying a high frequency weak or small current between any two points of a living body through electrodes and measuring a potential difference in this current path through electrodes or an apparatus which acquires biological composition data based on the bioelectrical impedance value or the measured potential difference is well known. The apparatus may use a plurality of electrodes connected to the main unit of the apparatus via electric cables so as to supply a high frequency current between any two points of a living body and/or measure a potential difference in this current path.

As the electric cables which connect these electrodes to the main unit of the apparatus, a single core cable having a single conductive core wire covered with an insulator has heretofore been used. However, the single core cable is liable to cause measurement errors since electrical signals passing through the core wire also pass through another cable through an electrostatic capacitance between the cables or dissipate into the ground through a stray capacitance between the cable and the ground. The degrees of these errors change because the electrostatic capacitance between the cables or the stray capacitance between the cable and the ground change according to the positions of the cables, thereby causing significantly poor measurement reproducibility. Further, these errors become large when relatively long cables are used (when the distance between the main unit of the apparatus and a living body to be measured is large) and become larger along with an increase in the frequency of an electrical signal used for measurements. In particular, an electric cable for measuring a potential difference which carries the potential signal of a living body has a very high impedance and is vulnerable to noise from the outside and susceptible to the influence of the noise. The influence causes errors in the absolute value of a bioelectrical impedance and the phase thereof. The latter (error in the phase) is liable to become larger along with an increase in the frequency of an electrical signal used for measurements.

As a method for suppressing the measurement errors, a so-called "active shield" method using a shielded cable as the electric cables is known (refer to Non-Patent Publication 1, for example). According to this method, a shield is provided around the circumference of a film covering a core wire and is driven by an electrical signal which is the same as or slightly smaller than an electrical signal passing through the core wire. Thus, since the core wire is shielded from the outside by the shield, the electrical signal passing through the core wire is not influenced by the electrostatic capacitance between the cables and the stray capacitance between the cable and the ground, and since the shield is so driven as to retain the same potential as the core wire, an electrostatic capacitance between the core wire and the shield apparently does not exist. As a result, measurement errors as described above are suppressed.

Further, with respect to a stray capacitance between an electric cable and the ground, the present applicant proposes a bioelectrical impedance measurement apparatus which has a high input impedance buffer circuit in the vicinity of electrodes used for measurement of potential difference and uses a shielded cable connected to a ground potential as electric cables which connect the electrodes to the main unit of the apparatus, thereby making it possible to avoid the influence of a stray capacitance between the cable and the ground (refer to Patent Publication 1).

Non-Patent Publication 1

Settle et al., "Nutritional Assessment: Whole Body Impedance and Body Fluid Compartments", NUTRITION AND CANCER, 1980, vol. 2, No. 1, p. 72 to 80

Patent Publication 1

Japanese Patent Laid-Open Publication No. 2001-61804

The foregoing active shield has a problem that a drive circuit therefor requires a buffer amplifier which operates stably over a wide frequency band so as to obtain the effect of suppressing the measurement errors by the active shield stably, thereby making the cost of the apparatus high.

In general, a buffer amplifier with a capacitive load connected thereto is liable to cause high frequency parasitic oscillation and is often unstable. That is, since an active shield using a buffer amplifier itself constitutes a positive feedback loop, oscillation by positive feedback occurs between the input side and output side of the buffer amplifier if the gain of the buffer amplifier is larger than 1. To prevent the parasitic oscillation, the gain of the buffer amplifier must be equal to or smaller than 1. When such a buffer amplifier with a gain of +1 is to be achieved over a wide frequency band, the cost of the buffer amplifier increases, thereby making the cost of the whole apparatus high.

In addition, when the shielded cable is to be used in an apparatus which acquires a bioelectrical impedance or biological composition data, the buffer amplifier must operate stably over a wide band even if the load of a subject (living body) is not pure resistance and changes according to its impedance status. This further increases the cost of the amplifier.

Further, the active shield has a possibility that the shield itself acts as an antenna and irradiates therethrough electromagnetic wave noise generated inside the main unit of an apparatus to which the shield is connected to the outside. As a result, in the presence of other electronic devices, it may influence these other electronic devices.

Meanwhile, in the case of a shielded cable as disclosed in the foregoing Patent Publication 1, i.e., a shielded cable connected to a ground potential, since an electrical signal passing through a core wire is driven by a low impedance by providing a high input impedance buffer circuit in the vicinity of electrodes as in the bioelectrical impedance measurement apparatus of the foregoing Patent Publication 1, attenuation thereof is little. However, when the high input impedance buffer circuit is not provided in the vicinity of electrodes, an electrical signal passing through the core wire is more liable to dissipate into the ground via the shield connected to the ground potential along with an increase in the frequency of the electrical signal, thereby causing measurement errors.

SUMMARY OF THE INVENTION

A shielded cable of the present invention is a shielded cable comprising:

a core wire for carrying an electrical signal, and a shield provided around the circumference of the core wire and connected to the core wire via a drive circuit, wherein the drive circuit has a band limiting circuit which- decreases an output voltage in a predetermined frequency band.

Further, the shield cable of the present invention further comprises a second shield provided around the circumference of the above shield and connected to a stable potential with a low impedance.

The potential to which the second shield is connected is preferably a ground potential.

Further, an apparatus of the present invention for acquiring a bioelectrical impedance value or biological composition data is an apparatus for acquiring a bioelectrical impedance value or biological composition data by supplying a high frequency weak or small current between any two points of a living body through electrodes and measuring a potential difference in the current path through electrodes, wherein an electric cable which connects the main unit of the apparatus to the electrode comprises a core wire for carrying an electrical signal and a shield provided around the circumference of the core wire and connected to the core wire via a drive circuit having a band limiting circuit which decreases an output voltage in a predetermined frequency band.

Further, in the apparatus of the present invention for acquiring a bioelectrical impedance value or biological composition data, the electric cable further comprises a second shield provided around the circumference of the shield and connected to a stable potential with a low impedance.

The potential to which the second shield is connected is preferably a ground potential.

In a shielded cable according to the present invention, an output voltage from a drive circuit can be decreased in a predetermined frequency band not required for measurements by adjusting (arbitrarily setting) the frequency characteristic of a band limiting circuit incorporated in the drive circuit situated between a core wire and a shield. As a result, while the effect of an active shield is retained in a frequency band (including a band required for the measurements) excluding the predetermined frequency band, the effect of the active shield can be decreased in the predetermined frequency band, i.e., the gain of a buffer amplifier constituting the drive circuit can be made smaller than 1 deliberately. Accordingly, the buffer amplifier may be any buffer amplifier which accommodates to a frequency band (including the band required for the measurements) excluding the predetermined frequency band, and it becomes possible to form a low-cost active shield by use of an inexpensive buffer amplifier. At the same time, an effect of decreasing electromagnetic wave noise irradiated to the outside through the shield can be expected.

Further, when a second shield connected to a stable potential with a low impedance, preferably a ground potential, is provided around the circumference of the shield, the electromagnetic wave noise irradiated to the outside through the shield can be suppressed nearly securely, and resistance to electromagnetic wave noise coming in from the outside can be improved. Further, even when the second shield is provided, the second shield does not influence an electrical signal passing through the core wire because the active shield functions effectively in the frequency band required for the measurements.

Further, in an apparatus for acquiring a bioelectrical impedance or biological composition data according to the present invention, the shielded cable according to the present invention is used as electric cables which connect electrodes to the main unit of the apparatus. Thus, while the occurrence of measurement errors is inhibited by maintaining the effect of the active shield in a frequency band required for measurement(s) of high frequency current value supplied to a living body and/or a potential difference occurring in the living body, an increase in the cost of the apparatus can be suppressed as a whole by suppressing the cost of a drive shield for the active shield.

Further, when the electric cable has the second shield connected to a stable potential with a low impedance, preferably a ground potential of the main unit of the apparatus, irradiation of electromagnetic wave noise generated inside the main unit of the apparatus to the outside and penetration of electromagnetic wave noise from the outside into the main unit of the apparatus can be prevented. Thus, even in the presence of other electronic devices, the present apparatus can be used without influencing these other electronic devices or being influenced by these other electronic devices.

DETAILED DESCRIPTION OF THE PREFERRED EMBODIMENTS

A shielded cable of the present invention incorporates a band limiting circuit which decreases the effect of an active shield in a predetermined frequency band not required for measurements in a drive circuit situated between a core wire and a shield connected to the core wire and uses an inexpensive buffer amplifier which accommodates only to a frequency band (including a band required for the measurements) excluding the predetermined frequency band as a buffer amplifier provided in the drive circuit so as to form a low-cost active shield, thereby reducing the cost of the whole apparatus while improving the measurement accuracy and measurement reproducibility of the apparatus.

Further, the shielded cable of the present invention has a second shield connected to a stable potential with a low impedance, preferably a ground potential, around the circumference of the shield, thereby suppressing electromagnetic wave noise irradiated to the outside through the shield nearly securely and improving resistance to electromagnetic wave noise coming in from the outside.

Further, an apparatus of the present invention for acquiring a bioelectrical impedance or biological composition data uses the shielded cable of the present invention to connect electrodes to the main unit of the apparatus. Thus, while the occurrence of measurement errors is inhibited by maintaining the effect of an active shield in a frequency band required for measurement(s) of high frequency current value supplied to a living body and/or a potential difference occurring in the living body, the cost of the shield cable is kept low, thereby suppressing an increase in the cost of the apparatus as a whole. Further, irradiation of electromagnetic wave noise generated inside the main unit of the apparatus to the outside and penetration of electromagnetic wave noise from the outside into the main unit of the apparatus are prevented by a second shield. Thus, even in the presence of other electronic devices, the present apparatus can be used without influencing these other electronic devices or being influenced by these other electronic devices.

EXAMPLE

Figure 1:
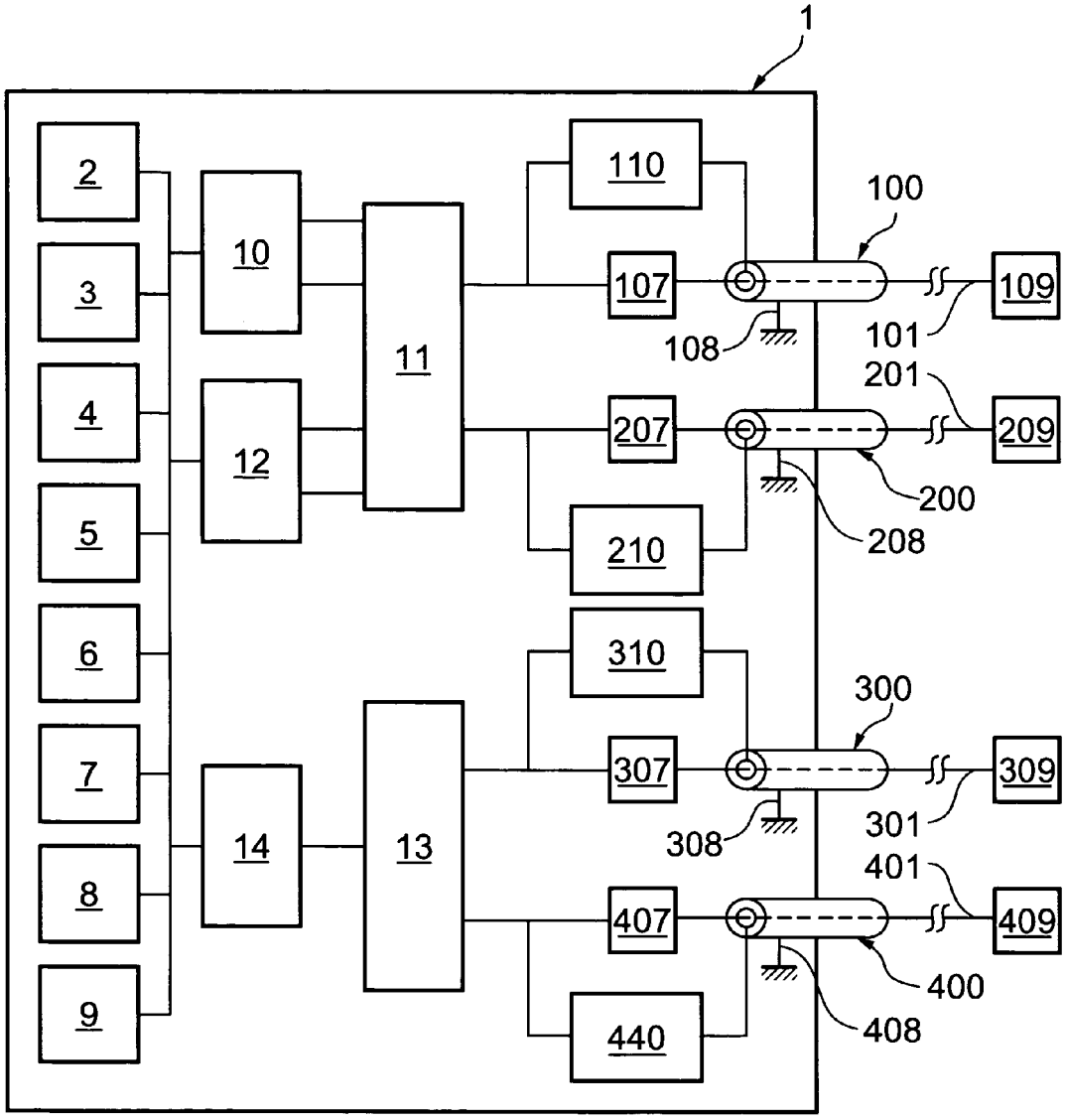
FIG. 1 is a schematic diagram showing the overall constitution of a biological composition data acquiring apparatus according to the present invention.
Figure 2:
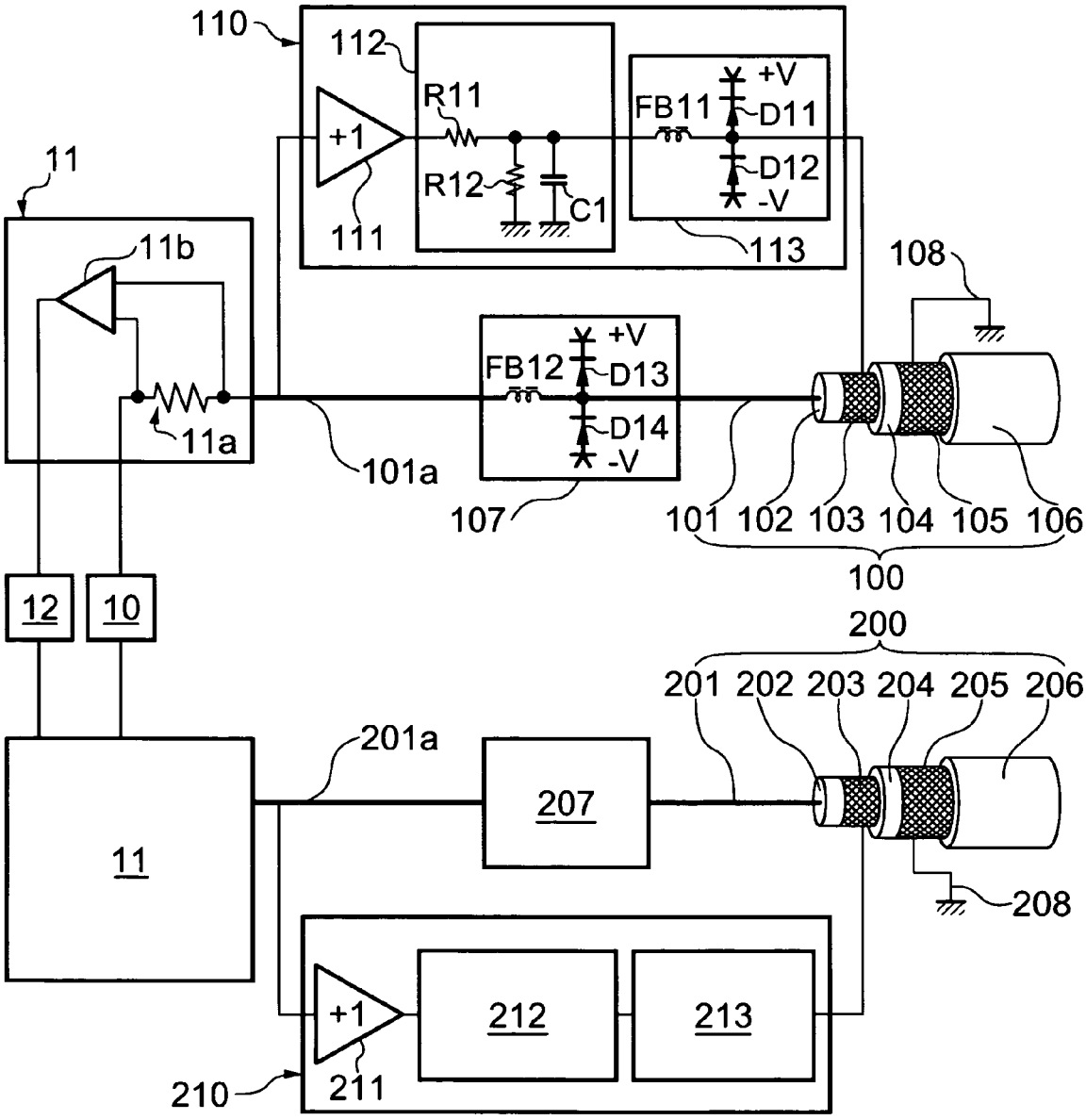
FIG. 2 is a schematic diagram showing the structure of the principal part of a shielded cable according to the present invention which is adopted in the biological composition data acquiring apparatus of FIG. 1.
Figure 3:
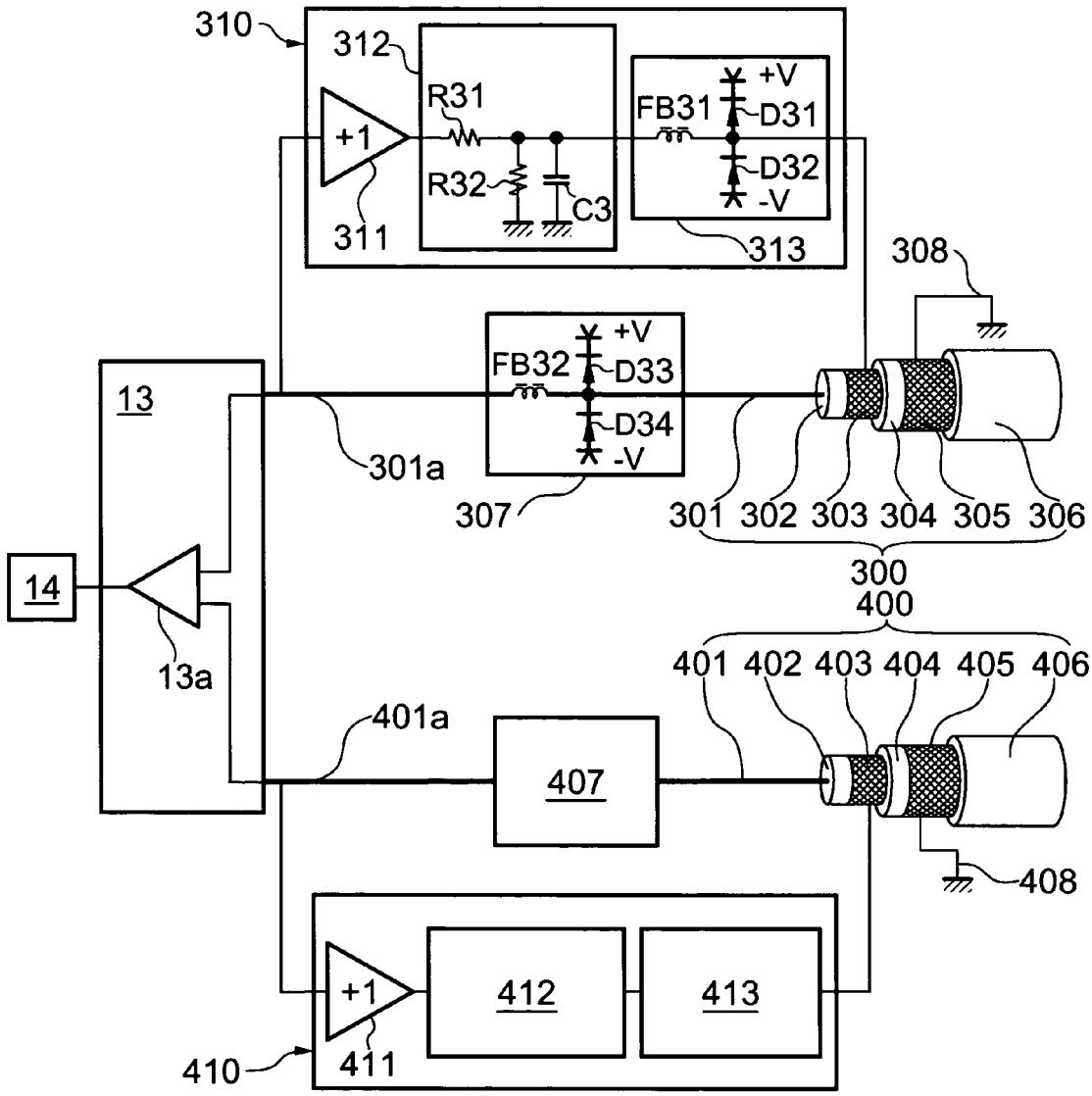
FIG. 3 is a schematic diagram showing the structure of the principal part of a shielded cable according to the present invention which is adopted in the biological composition data acquiring apparatus of FIG. 1.
Figure 4:
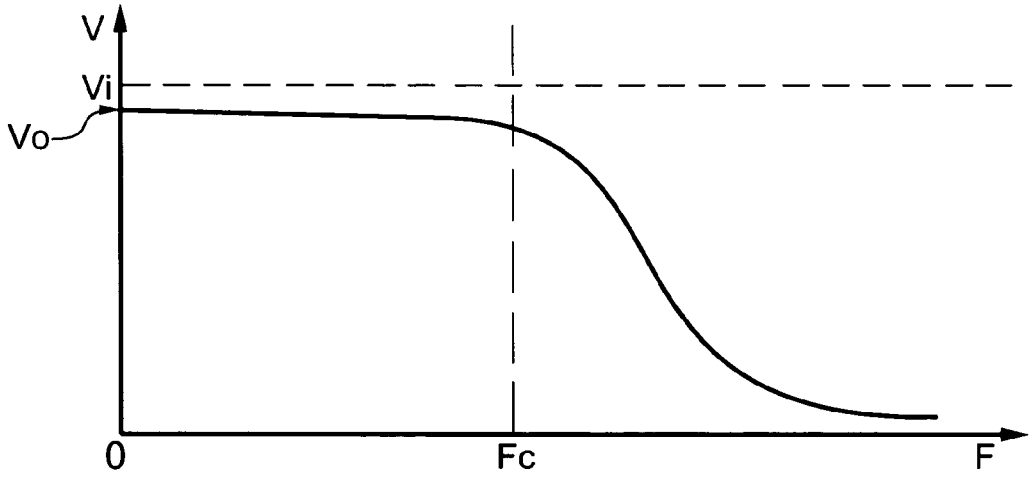
FIG. 4 is a diagram showing the frequency characteristic of a drive circuit of the shielded cable according to the present invention.

Hereinafter, a suitable embodiment of the present invention will be described with reference to the drawings. FIG. 1 is a schematic diagram showing the overall constitution of a biological composition data acquiring apparatus according to the present invention. FIGS. 2 and 3 are schematic diagrams showing the structures of the principal parts of shielded cables according to the present invention which are adopted in the biological composition data acquiring apparatus of FIG. 1. FIG. 4 is a diagram showing the frequency characteristic of a drive circuit of the shielded cable according to the present invention. FIG. 5 is a diagram showing the constitution patterns of the drive circuit of the shielded cable according to the present invention.

The biological composition data acquiring apparatus according to the present invention supplies a high frequency weak or small current between any two points of a subject (living body) so as to measure a potential difference occurring in this current path, determines a bioelectrical impedance value of the subject from the supplied current value and the measured potential difference, and calculates biological composition data of the subject such as a body fat mass (percentage), a visceral fat area, a body water content (percentage), a muscle mass (percentage), a bone mass and a basal metabolic rate based on the above bioelectrical impedance value and personal data such as a body height, a body weight, gender and age that the subject enters separately.

As shown in FIG. 1, the apparatus comprises a main unit 1, four electrodes 109, 209, 309 and 409, and electric cables 100, 200, 300 and 400 which connect the electrodes 109, 209, 309 and 409 to the main unit 1 electrically. The electrodes 109 and 209 are electrodes for supplying a high frequency weak or small current between any two points of a living body, and the electrodes 309 and 409 are electrodes for measuring a potential difference in a current path formed in the living body by the electrodes 109 and 209. The electric cables 100, 200, 300 and 400 each have a sufficient length to attach the respective electrodes 109, 209, 309 and 409 to the living body.

The main unit 1 comprises a display section 2 for displaying biological composition data calculated by the present apparatus or other data, an input section 3 for inputting personal data of a subject or other data, a ROM 4 that stores programs to calculate biological composition data and other data, a RAM 5 that serves as a temporary storage area for executing the calculation program or the like, a CPU 6 for executing the calculation program or the like, an auxiliary storage unit 7 for storing the above personal data and calculated biological composition data or other data, an external input/output interface section 8 for controlling data input/output between the display section 2 or input section 3 and the CPU 6, a power source 9 for supplying electric power to each electric circuit in the main unit 1, a high frequency constant current output section 10 for supplying a high frequency weak or small current to the electrodes 109 and 209 via the electric cables 100 and 200, a current detection section 11 for detecting a current value output from the high frequency constant current output section 10, an A/D converter 12 for digitizing a current value signal detected by the current detection section 11, a potential difference detection section 13 for detecting a potential difference between the electrodes 309 and 409 via the electric cables 300 and 400, and an A/D converter 14 for digitizing a potential difference signal detected by the potential difference detection section 13.

Referring to the structure of its principal part shown in FIG. 2, the electric cable 100 is a double shielded cable comprising a core wire 101 for carrying an electrical signal (i.e., a high frequency weak or small current output from the high frequency constant current output section 10), an insulative film 102 which covers the core wire 101, a conductive shield 103 (hereinafter referred to as "inner shield" for the sake of convenience) which covers the circumference of the film 102, an insulative film 104 which covers the inner shield 103, a conductive, second shield 105 (hereinafter referred to as "outer shield" for the sake of convenience) which covers the circumference of the film 104, and an insulative film 106 which covers the outer shield 105. A description of the electric cable 200 will be omitted since it has the same structure as that of the electric cable 100.

The core wire 101 of the electric cable 100 is connected to a resistance 11*a* which is provided in the current detection section 11 via a protection circuit 107 which comprises a ferrite bead FB12 and diodes D13 and D14, and the resistance 11*a* is connected to the high frequency constant current output section 10. Both sides of the resistance 11*a* are connected to the input side of a buffer amplifier 11*b* for detecting a current value, and the output side of the buffer amplifier 11*b* is connected to the A/D converter 12. That is, a current value output from the high frequency constant current output section 10 and passing through the core wire 101 of the electric cable 100 is measured based on a potential difference between before and after the resistance 11*a* which is detected by the buffer amplifier 11*b*.

Further, the core wire 101 of the electric cable 100 is connected to-the inner shield 103 via a drive circuit 110. The drive circuit 110 comprises a buffer amplifier 111 with a gain of +1 whose input side is connected to a conductor 101*a* which connects the core wire 101 (protection circuit 107) to the current detection section 11 and output side is connected to the inner shield 103. Between the buffer amplifier 111 and the inner shield 103, there are provided a band limiting circuit 112 that comprises resistances R11 and R12 and a condenser C1 and a protection circuit 113 that comprises a ferrite bead FB11 and diodes D11 and D12.

The band limiting circuit 112 causes the drive circuit 110 to have such a frequency characteristic as shown by a solid line in FIG. 4. In FIG. 4, the horizontal axis represents a frequency, and the vertical axis represents a voltage. Further, Vi represents an input voltage to the drive circuit 110, and Vo represents an output voltage from the drive circuit 110. That is, the drive circuit 110 outputs an output voltage Vo which is nearly equal to an input voltage Vi in a lower frequency band than a predetermined frequency Fc which is specified by a circuit constant, and the output voltage Vo decreases in a frequency band higher than the frequency Fc.

As a result, in the electric cable 100, the inner shield 103 is driven at about the same potential as the core wire 101 in a band equal to or lower than the frequency Fc and acts as an active shield, thereby inhibiting attenuation of an electrical signal carried through the core wire 101. On the other hand, in a band higher than the frequency Fc, the inner shield 103 does not act as an active shield since the output voltage from the drive circuit 110 decreases, so that an electrical signal carried through the core wire 101 is attenuated by the influence of a capacitance between the core wire 101 and the inner shield 103.

The predetermined frequency Fc is set to include a frequency band required for measurements in this biological composition data acquiring apparatus, and the effect of the active shield is retained within the frequency band. The frequency Fc can be set arbitrarily by selecting the resistance values of the resistances R11 and R12 and the capacity of the condenser C1 in accordance with the following formula (1).

$$Fc=(R11+R12)/2\pi\times C1\times R11\times R12 \quad (1)$$

Figure 5A:
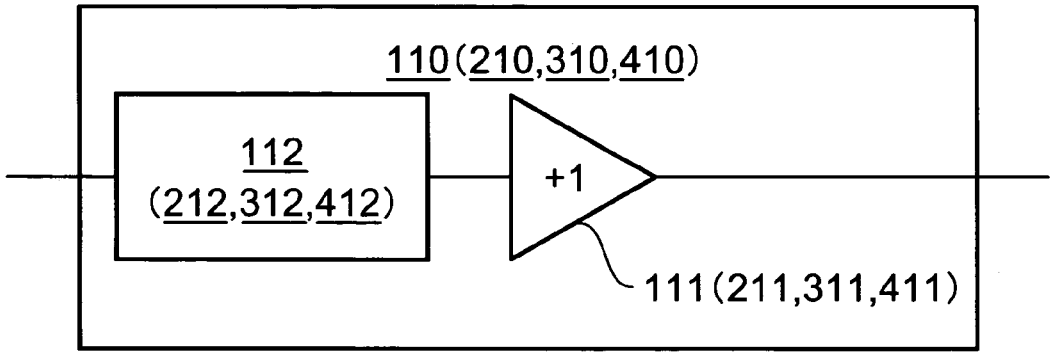
FIG. 5 is a diagram showing the constitution patterns of the drive circuit of the shielded cable according to the present invention.
Figure 5B:
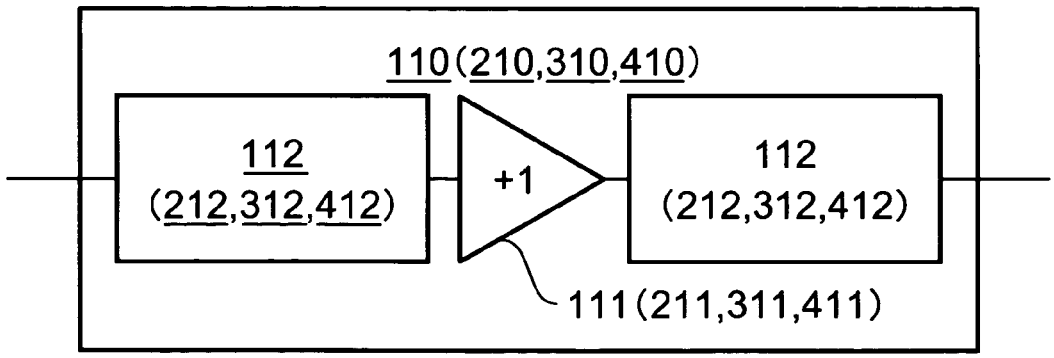

As shown in FIG. 5, the band liming circuit 112 may be placed at the input side of the buffer amplifier 111 (refer to FIG. 5A) or may be placed at both input and output sides of the buffer amplifier 111 (refer to FIG. 5B).

Meanwhile, the outer shield 105 is connected to a ground potential 108 that is a stable potential with a low impedance. As a result, irradiation of electromagnetic wave noise generated inside the main unit 1 to the outside through the electric cable 100 is inhibited, and penetration of electromagnetic wave noise from the outside into the cable portion underneath the outer shield 105 is prevented.

Referring to the structure of its principal part shown in FIG. 3, the electric cable 300 is a double shielded cable comprising, as in the case of the electric cables 100 and 200, a core wire 301 for carrying an electrical signal (i.e., a potential signal detected by the electrode 309), an insulative film 302 which covers the core wire 301, a conductive inner shield 303 which covers the circumference of the film 302, an insulative film 304 which covers the inner shield 303, a conductive outer shield 305 which covers the circumference of the film 304, and an insulative film 306 which covers the outer shield 305. A description of the electric cable 400 will be omitted since it has the same structure as that of the electric cable 300.

The core wire 301 of the electric cable 300 is connected to one input side of a buffer amplifier 13*a* for detecting a potential difference which is provided in the potential difference detection section 13 via a protection circuit 307 which comprises a ferrite bead FB32 and diodes D33 and D34. Further, to the other input side of the buffer amplifier 13*a*, the core wire 401 of the electric cable 400 is connected, and the output side of the buffer amplifier 13*a* is connected to the A/D converter 14. That is, a potential difference between the electrode 309 and the electrode 409 is measured by the buffer amplifier 13*a*.

Further, the core wire 301 of the electric cable 300 (to be accurate, a conductor 301*a* which connects the protection circuit 307 to the potential difference detection 13) is connected to the inner shield 303 via a drive circuit 310. As in the case of the drive circuit 110 of the electric cable 100, the drive circuit 310 comprises a buffer amplifier 311 with a gain of +1 whose input side is connected to the core wire 301 and output side is connected to the inner shield 303. Between the buffer amplifier 311 and the inner shield 303, there are provided a band limiting circuit 312 which comprises resistances R31 and R32 and a condenser C3 and a protection circuit 313 which comprises a ferrite bead FB31 and diodes D31 and D32.

As in the case of the band limiting circuit 112 of the electric cable 100, the resistances R31 and R32 and condenser C3 of the band limiting circuit 312 in the drive circuit 310 are selected appropriately so that the drive circuit 310 has such a frequency characteristic as shown in FIG. 4. Therefore, the inner shield 303 acts as an active shield in a frequency band required for measurements in the present biological composition data acquiring apparatus, and the effect of the active shield is decreased in a frequency band which is not required for the measurements.

Further, as in the case of the outer shield 105 of the electric cable 100, the outer shield 305 is also connected to a ground potential 308 which is a stable potential with a low impedance. As a result, irradiation of electromagnetic wave noise generated in the main unit 1 to the outside through the electric cable 300 is inhibited, and penetration of electromagnetic wave noise from the outside into the cable portion underneath the outer shield 305 is prevented.

As shown in FIG. 1, the protection circuits 107, 207, 307 and 407, drive circuits 110, 210, 310 and 410 and ground potentials 108, 208, 308 and 408 of the electric cables 100, 200, 300 and 400 are provided in the main unit 1.

As described above, in the electric cables 100, 200, 300 and 400 of the present embodiment, the effects of the active shields are decreased in a predetermined frequency band not required for measurements by incorporating the band limiting circuits 112, 212, 312 and 412 into the drive circuits 110, 210, 310 and 410 situated between the core wires 101, 201, 301 and 401 and the inner shields 103, 203, 303 and 403. As a result, the electric cables are formed as low-cost shielded cables by using an inexpensive buffer amplifier which accommodates only to a frequency band (including a band required for the measurements) excluding the predetermined frequency band for the buffer amplifiers 111, 211, 311 and 411 of the drive circuits 110, 210, 310 and 410.

Further, in the electric cables 100, 200, 300 and 400 of the present embodiment, the outer shields 105, 205, 305 and 405 connected to the ground potentials 108, 208, 308 and 408 are provided around the circumferences of the inner shields 103, 203, 303 and 403. Thereby, electromagnetic wave noise irradiated to the outside through the inner shields 103, 203, 303 and 403 is suppressed nearly securely, and resistance to electromagnetic wave noise coming in from the outside is improved.

Further, the biological composition data acquiring apparatus of the present embodiment has a constitution that the electrodes 109, 209, 309 and 409 are connected to the main unit 1 of the apparatus by the electric cables 100, 200, 300 and 400. Thus, while the occurrence of measurement errors is inhibited by maintaining the effect of the active shield in a frequency band required for measurement(s) of high frequency current value supplied to a living body and/or a potential difference occurring in the living body, the costs of the electric cables 100, 200, 300 and 400 are kept low, thereby suppressing an increase in the cost of the apparatus as a whole. Further, in the biological composition data acquiring apparatus of the present embodiment, irradiation of electromagnetic wave noise generated in the main unit 1 of the apparatus to the outside and penetration of electromagnetic wave noise from the outside into the main unit of the apparatus are prevented by the outer shields 105, 205, 305 and 405. Thus, even in the presence of other electronic devices, the present apparatus can be used without influencing these other electronic devices or being influenced by these other electronic devices.

In addition to an apparatus which acquires a bioelectrical impedance or biological composition data as in the present embodiment, the shielded cable of the present invention can be applied to a wide variety of applications as an electric cable for carrying an electrical signal.

Further, the present apparatus for acquiring a bioelectrical impedance or biological composition data has no need to use the shielded cable of the present invention for all of the electric cables which connect the electrodes to the main unit of the apparatus and can be altered and practiced as appropriate. For example, the shielded cable of the present invention may be used only for electric cables for measuring a potential difference. Further, the present apparatus for acquiring a bioelectrical impedance or biological composition data may have two or more (e.g., four) electrodes and electric cables for supplying a high frequency weak or small current and two or more (e.g., four) electrodes and electric cables for measuring a potential difference.

What is claimed is:

1. A shielded cable comprising:

a core wire for carrying an electrical signal, a shield provided around the circumference of the core wire, and a drive circuit on a line electrically connecting the core wire to the shield, wherein the shield is drivable to act as an active shield for shielding the core wire from outside, responsive to an output voltage from the drive circuit, and wherein the drive circuit has a band limiting circuit for decreasing the output voltage in a predetermined frequency band such that the shield does not act as the active shield.

2. The cable of claim 1, further comprising a second shield provided around the circumference of the shield and connected to a stable potential with a low impedance.

3. The cable of claim 2, wherein the potential to which the second shield is connected is a ground potential.

4. An apparatus for acquiring a bioelectrical impedance value or biological composition data by supplying a high frequency weak or small current between any two points of a living body through electrodes and measuring a potential difference in the current path through electrodes, wherein an electric cable which connects a main unit of the apparatus to the electrode comprises;

a core wire for carrying an electrical signal, a shield provided around the circumference of the core wire, and a drive circuit on a line electrically connecting the core wire to the shield, wherein the shield is drivable to act as an active shield for shielding the core wire from outside, responsive to an output voltage from the drive circuit, and wherein the drive circuit has a band limiting circuit for decreasing the output voltage in a predetermined frequency band such that the shield does not act as the active shield.

5. The apparatus of claim 4, wherein the electric cable further comprises a second shield provided around the circumference of the shield and connected to a stable potential with a low impedance.

6. The apparatus of claim 5, wherein the potential to which the second shield is connected is a ground potential.

* * * * *